United States Patent [19]

Parkins

[11] Patent Number: 4,741,065

[45] Date of Patent: May 3, 1988

[54] INTERLOCKING DUST CONTROL MATS

[75] Inventor: John H. Parkins, LaGrange, Ga.

[73] Assignee: Milliken Research Corporation, Spartanburg, S.C.

[21] Appl. No.: 23,768

[22] Filed: Mar. 9, 1987

[51] Int. Cl.[4] ..... B32B 3/10

[52] U.S. Cl. ..... 15/217; 15/216; 16/8; 52/177; 428/62

[58] Field of Search ..... 15/215, 216, 217; 52/177; 428/61, 62; 16/8

[56] References Cited

U.S. PATENT DOCUMENTS

| | | | |
|---|---|---|---|
| 2,194,653 | 3/1940 | Gell | 15/215 X |
| 2,673,169 | 3/1954 | Finch | 428/62 |
| 4,167,599 | 9/1979 | Nissinen | 52/177 X |
| 4,287,693 | 9/1981 | Collette | 52/177 |
| 4,468,910 | 9/1984 | Morrison | 52/177 X |
| 4,478,901 | 10/1984 | Dickens et al. | 52/177 X |

FOREIGN PATENT DOCUMENTS

| | | | |
|---|---|---|---|
| 567944 | 12/1958 | Canada | 428/62 |

*Primary Examiner*—Chris K. Moore

*Attorney, Agent, or Firm*—Earle R. Marden; H. William Petry

[57] ABSTRACT

A plurality of rubber-backed dust control mats are interconnected by a connecting strip which has projections thereon which engage mating projections on the outer surface of the rubber backing on the mats.

5 Claims, 1 Drawing Sheet

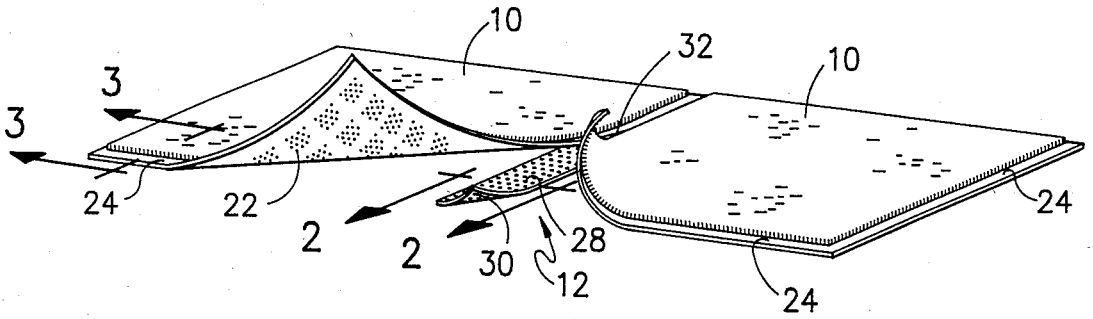
FIG. — 1 —
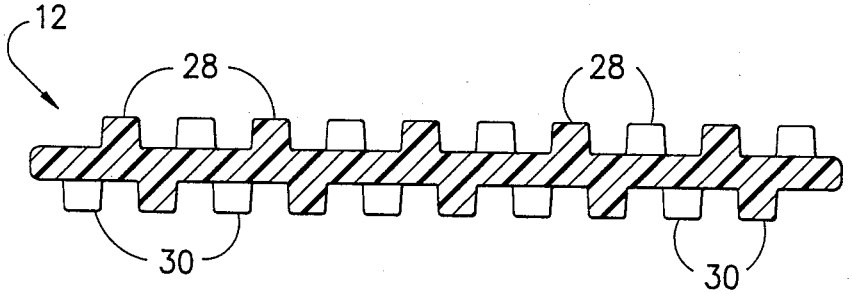
FIG. — 2 —
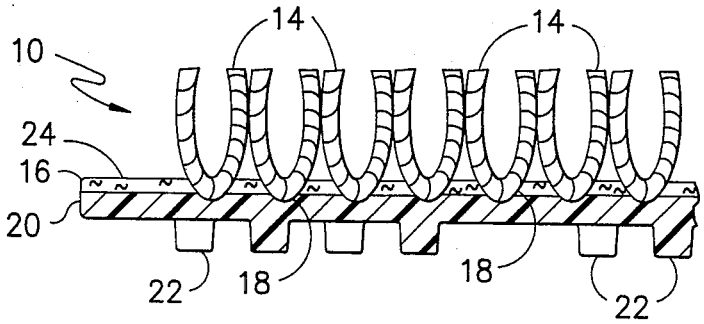
FIG. — 3 —

INTERLOCKING DUST CONTROL MATS

This invention relates generally to rubber-backed dust control floor mats of the type which have a pile surface on one side and a rubber or rubber-like material on the other side. Mats of this type are generally used in access ways where people tend to brush or scrape their feet in order to prevent carrying of moisture and/or dirt, accumulated on their footwear, into other areas of the premises. Normally these mats are located in areas of high pedestrian traffic, such as doorways.

In recent years the industry has been requesting larger and/or longer dust control mats but such mats create problems in manufacture and in laundering due to the mats being too long to efficiently mold and/or launder in existing industrial laundry equipment.

Therefore, it is an object of the invention to provide a system wherein standard size mats may be interconnected by the consumer to provide the effect of larger and longer dust control mats.

Other objects and advantages of the invention will become readily apparent as the specification proceeds to describe the invention with reference to the accompanying drawing, in which:

FIG. 1 shows a pair of standard interconnected dust control mats;

FIG. 2 is section view of the interconnecting strip used in FIG. 1 and

FIG. 3 is a sectional view taken on line 3—3 of FIG. 1.

Looking now to the drawings and especially to FIG. 1, a pair of standard size, rubber-backed dust control mats 10 are shown interconnected by a rubber or rubber-like connecting strip 12. Standard size mats are in the range of 3'×4'; 3'×5'; etc. To achieve larger sizes and longer runner sizes these mats may be joined as shown in FIG. 1 at the time of installation.

In the preferred form of the invention the mats 10 consist of pile yarns 14 of cotton, polyester, etc. tufted through a woven or non-woven substrate 16 of suitable material with the bottom 18 of the tufts adhered to the rubber or rubber-like backing 20 during vulcanization. Molded integral with or otherwise secured to the bottom of the backing 20 are a plurality of anti-creep cleats 22. Each of the mats commonly have a border portion 24 therearound but, obviously the borders can be eliminated if it is desired to have a continuous pile surface. The cleats 22 are arranged in a desired pattern to interlock with the pattern of cleats 28 on the upper surface of interconnecting strip 12.

The interconnecting strip 12 of rubber or other suitable material has cleats 28 on the upper surface thereof for reasons previously set forth. The strip 12 also has cleats 30 on the bottom thereof in any suitable pattern which, like cleats 22, act as friction resistant elements to resist creeping to minimize movement of the carpets on the surface on which it is placed.

As shown in FIG. 1, the strip 12 is placed on the surface to be covered and adjacent mats are located thereover with the abutting seam 32 centrally of the strip. The mats 10 are then pressed downwardly so that the cleats 22 of the mats 10 and the cleats 28 of the strip 12 interlock to form a longer or wider dust control mat. It is obvious that further mats 10 and strips 12 can be added to increase the surface covered by a substantially continuous dust control mat.

It can be seen that the herein described dust control mat can be readily manufactured since it is comprised of standard commercially available sizes and laundered in existing laundering equipment. Furthermore, the installation of such mats is accomplished in very little time and provides the ultimate user flexibility as to size using currently available mats.

Although the preferred embodiment of the invention has been described, it is contemplated that many changes may be made without departing from the scope or spirit of the invention and it is desired that the claims be limited only by the claims.

I claim:

1. A large dust control mat having a plurality of interconnected smaller dust control mats comprising: a first dust control mat having a predetermined pattern of cleats on the bottom thereof, a second dust control mat having a predetermined pattern of cleats on the bottom thereof, a connecting strip under said first and said second dust control mats having cleats on the upper surface thereof mating with the cleats on the bottom of said first and second dust control mats, said first and second dust control mats being closely adjacent one another.

2. The mat of claim 1 wherein said first and second dust control mats abut one another.

3. The mat of claim 2 wherein said connecting strip has cleats on the undersurface thereof to provide a friction resistant surface.

4. The mat of claim 1 wherein said cleats on said first and second dust control mats are molded integral with the bottoms of said mats.

5. A large dust control mat having a plurality of interconnected smaller dust control mats which have an upper nap surface of pile fibers and a rubber-like backing material, said large dust mat comprising: a first dust control mat having a pre-determined pattern of cleats molded to the rubber-like backing, a second dust control mat closely adjacent to said first dust control mat and having a plurality of cleats molded in a pre-determined pattern to the rubber-like backing thereof and a rubber-like connecting strip located under said first and second dust control mats having a plurality of cleats molded in the upper surface thereof interconnected with the cleats on the bottoms of said mats. having a plurality of cleats molded in the upper surface thereof interconnected with the cleats on the bottoms of said mats.

* * * * *

UNITED STATES PATENT AND TRADEMARK OFFICE

CERTIFICATE OF CORRECTION

PATENT NO. : 4,741,065

DATED : May 3, 1988

INVENTOR(S) : John H. Parkins

It is certified that error appears in the above-identified patent and that said Letters Patent is hereby corrected as shown below:

Column 2, line 54, after "mats." -- delete the phrase beginning "having a . . ." through line 57.

Signed and Sealed this

Ninth Day of May, 1989

*Attest:*

DONALD J. QUIGG

*Attesting Officer*

*Commissioner of Patents and Trademarks*